US005951321A

United States Patent [19]

Jaag

[11] Patent Number: 5,951,321

[45] Date of Patent: Sep. 14, 1999

[54] MULTIPIN CONNECTOR ASSEMBLY

[75] Inventor: Dieter Jaag, Villingen-Schwenningen, Germany

[73] Assignee: RIA Electronic Albert Metz, Germany

[21] Appl. No.: 09/013,858

[22] Filed: Jan. 27, 1998

[30] Foreign Application Priority Data

Jan. 30, 1997 [DE] Germany ..... 197 03 381

[51] Int. Cl.[6] ..... H01R 4/24

[52] U.S. Cl. ..... 439/405; 439/417

[58] Field of Search ..... 439/404, 405, 439/924.1, 417

[56] References Cited

U.S. PATENT DOCUMENTS

| | | | |
|---|---|---|---|
| 3,432,795 | 3/1969 | Jayne | 439/924.1 |
| 5,059,137 | 10/1991 | Dale et al. | 439/395 |
| 5,338,220 | 8/1994 | Soes et al. | 439/417 |

FOREIGN PATENT DOCUMENTS

| | | | |
|---|---|---|---|
| 1176331 | 10/1984 | Canada | 339/29.2 |
| 0 489 549 A2 | 11/1991 | European Pat. Off. . | |
| 0 531 677 | 7/1992 | European Pat. Off. . | |
| 0 700 126 A1 | 9/1994 | European Pat. Off. . | |
| 93 10 211 | 7/1993 | Germany . | |

OTHER PUBLICATIONS

Research Disclosure, No. 280, Kenneth Meason Publications, Aug. 1992.

*Primary Examiner*—Gary F. Paumen
*Assistant Examiner*—Briggitte R. Hammond
*Attorney, Agent, or Firm*—Eugene E. Renz, Jr.

[57] ABSTRACT

A multipin connector assembly for electrical conductors comprising a lower block 10 and an upper block 12 means defining receiving channels 14 for the conductors in the lower block which proceed from a side surface and pass through the lower block, means defining contact channels, which lead down from the top surface of the lower block disposed generally perpendicularly to said side surface, and passing into the lower block, and insulation displacement contacts 20 in the upper block of a similar array to the arrangement of contact channels, said displacement contacts projecting from the bottom surface of the block whereby when the upper block 12 is set down onto the lower block 10, the insulation displacement contacts 20 of the upper block pass through the contact channels 18 of the lower block and make contact with conductors 16 passing through the receiving channels 14 of the lower block, the lengths of the insulation displacement contacts 20 being dimensioned in such a way that as the insulation displacement contacts 20 pass through the contact channels 18, they do not contact all the conductors 16 passing through the associated receiving channels 14 simultaneously.

2 Claims, 2 Drawing Sheets

MULTIPIN CONNECTOR ASSEMBLY

BACKGROUND OF THE INVENTION

Connectors of the type to which the present invention relate, facilitate connecting several conductors, e.g., the wires of a multiwire cable, quickly and easily. To this end, the individual conductors are inserted in the receiving channels of a lower block and then an upper block is set down onto the lower block. Insulation displacement contacts provided in the upper block are guided through contact channels in the lower block and can thus make electrical contact with the conductors which have been inserted into the receiving channels. The insulation displacement contacts have axially slotted ends, which are pushed on the conductors. The cutting edges at the slotted ends are in confronting relation so that they can penetrate through the insulation of the conductor. The edges then press into the peripheral surface of the conductor to produce good electrical contact.

A certain, predetermined axial force must be exerted on the insulation displacement contact for proper penetration and pressing of the contacts into the metallic conductors. For example, in the case of a multipin connector, where several electrical conductors are to be connected, the forces transmitted via the upper block to the individual insulation displacement contacts are additive. Thus, it is more difficult to make good contact and a considerable amount of force must be exerted on the upper block which in turn, must be absorbed by the lower block and its means of attachment.

SUMMARY OF THE INVENTION

With the foregoing in mind, it is an object of the present invention to provide an improved multipin connector of the general type described above characterized by novel features of construction and arrangement so that even when there are relatively large number of pins, establishing contact by means of insulation displacement contacts can be accomplished without exerting a large amount of force on the upper block.

To this end, in accordance the present invention, the lengths of the insulation displacement contacts are dimensioned in such a way that as the insulation displacement contacts pass through the contact channels, they do not contact all the conductors passing through the associated receiving channels simultaneously. More specifically, the basic idea of the invention is an arrangement wherein the insulation displacement contacts of the upper block are of different lengths. Accordingly, when the upper block is set in place and when the insulation displacement contacts penetrate into the contact channels of the lower block, the insulation displacement contacts engage with the associated conductors at different times. Therefore, the force required to cut through the insulation of all of the conductors and to press all of the associated insulation displacement contacts into the conductor simultaneously is considerably less than the force required to cut through the insulation of all of the conductors and to press all of the associated insulation displacement contacts into the conductors simultaneously. In accordance with the present invention, the cutting of the insulation and the pushing of the insulation displacement contacts into the conductors is done in a stepwise, sequential manner involving only a small number of the insulation displacement contacts at a time. The amount of force exerted on the upper block and the amount of pressure to be absorbed by the lower block are therefore considerably smaller than those of the known connectors. If, for example, the insulation displacement contacts of the upper block are divided into two groups, all the insulation displacement contacts of one group being of the same length, then the force to be exerted as well as the pressure to be absorbed are cut in half.

BRIEF DESCRIPTION OF THE DRAWINGS

These and other objects of the present invention and various features and details of the operation and construction thereof are hereinafter more fully set forth with reference to the accompanying drawings, wherein.

DETAILED DESCRIPTION OF THE PREFERRED EMBODIMENTS

Figure 1:
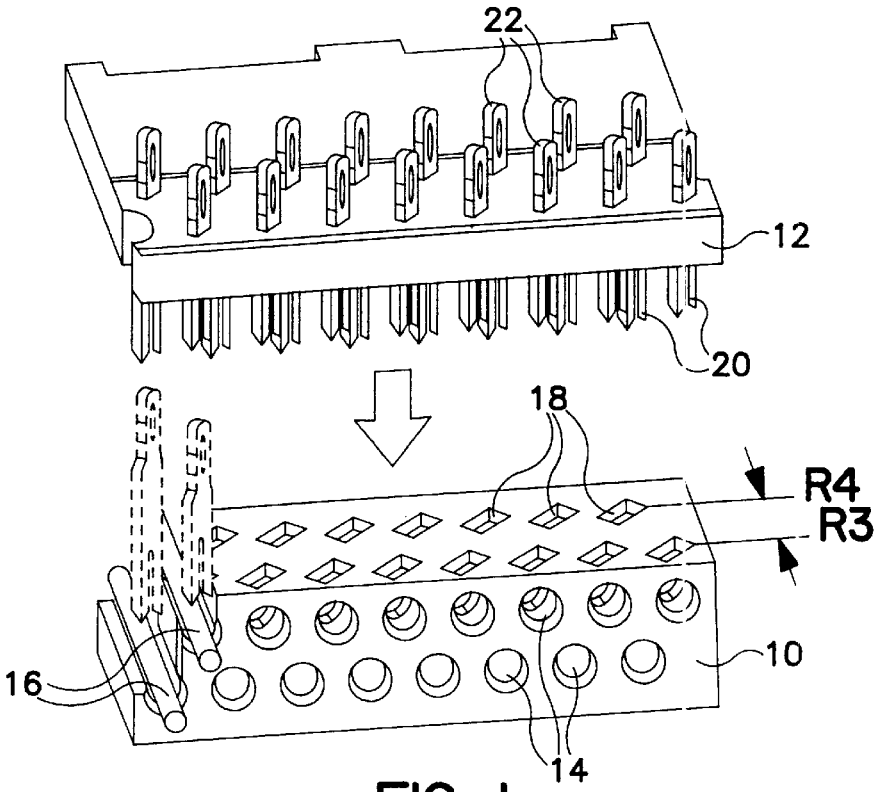
FIG. 1 is a perspective view of a connector assembly in accordance with the present invention.

Referring now to the drawings and particularly FIG. 1 thereof, the connector assembly of the present invention comprises a lower block 10 and an upper block 12 preferably made of a plastic material. The lower and upper blocks 10,12 can be set on each other in an essentially flush manner. In the drawing, the lower block 10 is cut away on the left side to show the internal construction more clearly.

Lower block 10 has receiving channels 14, which pass from the front side surface of block 10 perpendicularly through block 10. Receiving channels 14 have a circular cross section and are arranged in two rows $R_1$, $R_2$. In the lower row $R_2$, there are eight receiving channels 14, spaced equal distances "D" apart. Above this lower row, $R_2$, there is at a vertical distance "a", an upper row $R_1$ of receiving channels 14, which also contains eight receiving channels 14, spaced equal distances "$D_1$" apart. The receiving channels 14 of the upper row $R_1$ are offset by half a spacing interval with respect to receiving channels 14 of the lower row $R_2$. Receiving channels 14 make it possible to insert electrical conductors 16, e.g., insulated wires of a multiwire cable into the block.

From the top of lower block 10, i.e., the surface facing upper block 12, contact channels 18 lead down through lower block 10. Contact channels 18 are arranged in two rows $R_3$, $R_4$ which are spaced apart from each other in the axial direction of receiving channels 14. Contact channels 18 of the front row $R_3$ are arranged in such a way that they intersect the upper row of receiving channels 14 at a right angle. Contact channels 18 of the back row $R_4$ are arranged in such a way that they intersect the lower row $R_2$ of receiving channels 14 at a right angle. Thus, there is one contact channel 18 for each receiving channel 14. Contact channels 18 have a rectangular cross section, their cross-sectional surface being oriented preferably at a 45 degree angle to the axial direction of receiving channels 14.

Insulation displacement contacts 20 are embedded in upper block 12. Insulation displacement contacts 20 project downward from the bottom surface of upper block 12, for example, the surface facing lower block 10. Soldering terminals 22 of insulation displacement contacts 20 project up from the top of upper block 12. Insulation displacement contacts 20 are slotted axially in the standard way at their free lower ends, so that cutting edges are formed which face each other. The cross sections of insulation displacement contacts 20 match the cross sections of contact channels 18 and are arranged in the same way at a 45 degree angle with respect to the axial direction of receiving channels 14. The number and arrangement of insulation displacement contacts 20 also correspond to the number and arrangement of contact channels 18. When upper block 12 is set down from above onto lower block 10, as indicated in the drawing by an arrow, insulation displacement contacts 20 are thus able to pass through contact channels 18 of lower block 10.

Figure 2:
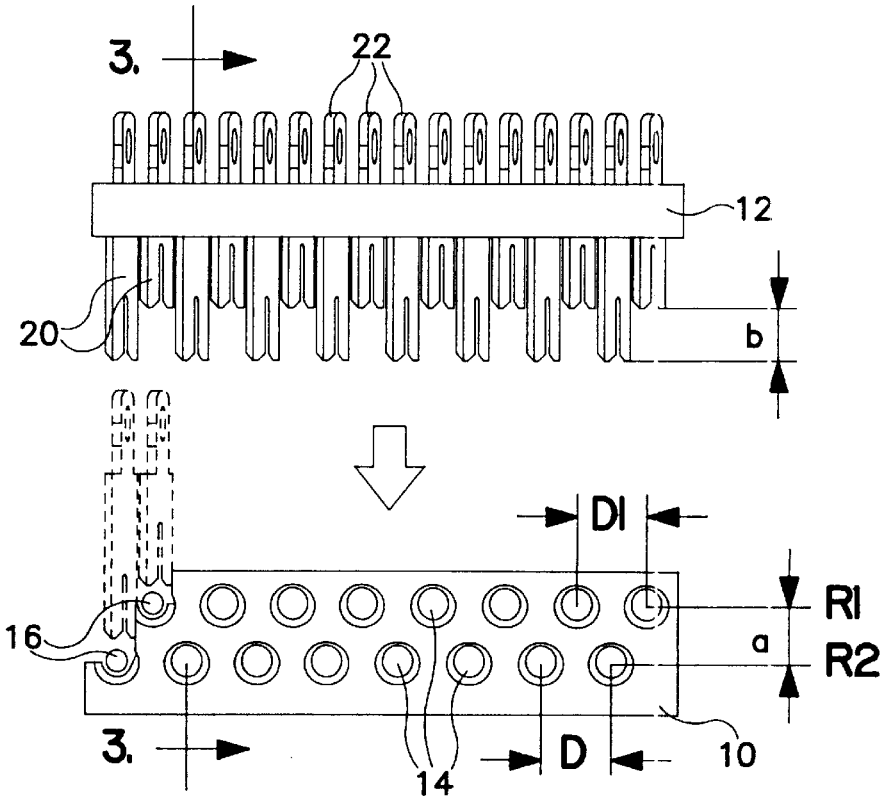
FIG. 2 is a front view of a connector assembly in accordance with the present invention.
Figure 3A:
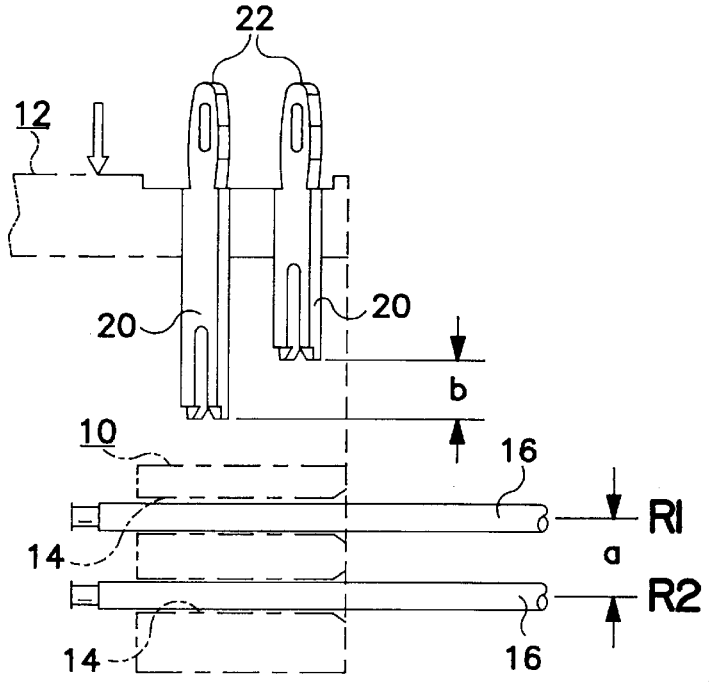
FIG. 3A is an enlarged fragmentary schematic sectional view taken on the line 3,3 of FIG. 2 showing the insulation displacement contacts and the conductors in full line and their respective supporting blocks in dot and dash outline, in order to illustrate the invention in greater clarity. The respective blocks are shown spaced apart prior to assembly.
Figure 3B:
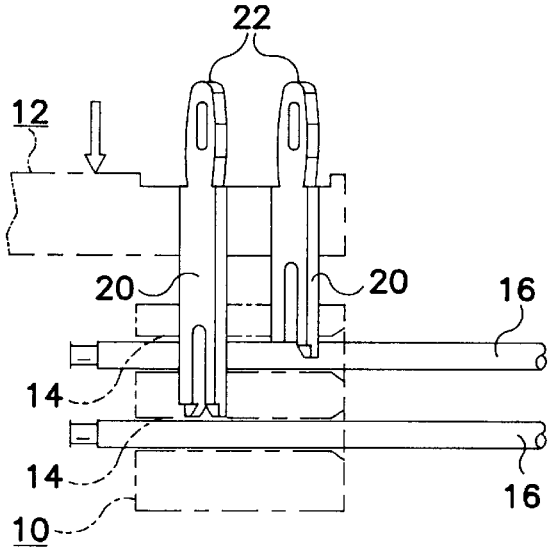
FIG. 3B is a schematic view similar to FIG. 3A but showing the two blocks partially assembled.
Figure 3C:
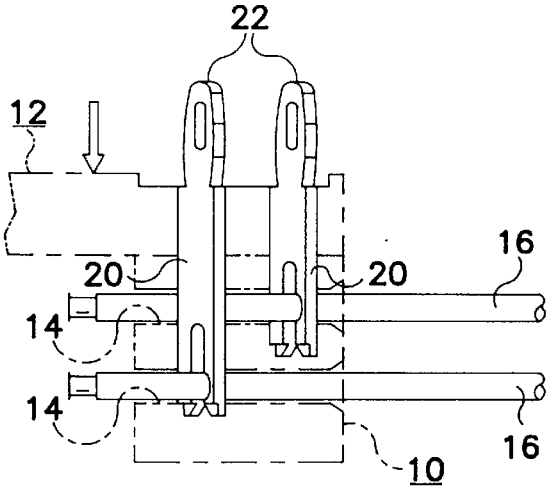
FIG. 3C is a schematic view similar to FIGS. 3A and 3B but showing the blocks fully assembled.

As is especially clear from FIGS. 3A–3C, insulation displacement contacts 20 of the front row $R_5$ and insulation displacement contacts 20 of the back row $R_6$ differ from each other in terms of axial length. The length of insulation displacement contacts 20 of the back row and the length of the those of the front row $R_5$ are calculated in such a way that, in a projection of the front surface (which corresponds to the diagram of FIG. 2), the free ends of insulation displacement contacts 20 of the front row $R_5$ are offset by a distance "b" from the free ends of insulation displacement contacts 20 of the back row $R_6$. This distance "b" is smaller than the vertical distance "a" between the two rows $R_1$, $R_2$ of receiving channels 14.

When upper block 12 is set down onto lower block 10 and insulation displacement contacts 20 pass through contact channels 18 of lower block 10, insulation displacement contacts 20 of the front row $R_5$ engage with conductors 16 of the upper row $R_1$ of receiving channels 14 first, as illustrated in dotted line on the left of the drawing. Insulation displacement contacts 20 of the front row $R_5$ are then pressed onto the associated conductors 16, the slot in insulation displacement contact 20 enclosing the associated conductor 16; the cutting edges formed by the slot cut through the insulation of conductor 16 and press against the lateral surface of conductor 16. During this process, the free ends of insulation displacement contacts 20 of the back row $R_6$ are still out of reach of conductors 16 in the lower row of receiving channels 14. As upper block 12 is pressed even farther down, insulation displacement contacts 20 of the back row $R_6$ do not engage with conductors 16 of the lower row of receiving channels 14 until after conductors 16 of the upper row of receiving channels 14 are lodged in the slots of insulation displacement contacts 20 of the front row $R_5$ and are thus contacted by them. Then, in a corresponding manner, conductors 16 of the lower row of receiving channels 14 are contacted by insulation displacement contacts 20 of the back row $R_6$. Because in each case, only the eight insulation displacement contacts 20 of the front row $R_5$ or of the back row $R_6$ must simultaneously cut through the insulation of the associated conductors 16, the force required to penetrate the insulation must be applied to two successive steps, each step thus requiring the exertion of only half as much force.

Even though a particular embodiment of the invention has been illustrated and described herein, it is not intended to limit the invention and changes and modifications may be made therein within the scope of the following claims.

What is claimed is:

1. A multipin connector assembly for electrical conductors comprising;

a lower block 10 and an upper block 12;

means defining receiving channels 14 for the conductors in the lower block which proceed from a side surface and pass through the lower block;

means defining contact channels 18, which lead down from the top surface of the lower block disposed generally perpendicularly to said side surface, and passing into the lower block;

insulation displacement contacts 20 in the upper block of a similar array to the arrangement of contact channels 18, said displacement contacts projecting from the bottom surface of the block whereby when the upper block 12 is set down onto the lower block 10, the insulation displacement contacts 20 of the upper block pass through the contact channels 18 of the lower block and make contact with conductors 16 passing through the receiving channels 14 of the lower block;

a plurality of soldering terminals 22 projecting from the top of upper block 12 corresponding in number and arrangement to the insulation displacement contacts 20;

the lengths of the insulation displacement contacts 20 being dimensioned in such a way that as the insulation displacement contacts 20 pass through the contact channels 18, they do not contact all the conductors 16 passing through the associated receiving channels 14 simultaneously;

said insulation displacement contacts 20 being divided into at least two groups, the contacts of each group being all of the same length, the insulation displacement contacts 20 of the respective groups contacting the associated conductors 16 in sequence as the contacts are pushed through the contact channels 18; and said receiving channels 14 being arranged in two rows $R_1$, $R_2$, one above the other a predetermined distance "a" apart, in such a way so that the receiving channels 14 of the upper row $R_1$ are offset by half a spacing with respect to the receiving channels 14 of the lower row $R_2$, said contact channels 18 being arranged in two rows $R_3$, $R_4$ separated from each other in the axial direction of the receiving channels 14 and the insulation displacement contacts 20 assigned to the contact channels 18 of a certain row all being of the same axial length; and the distance "a" between the two rows of receiving channels 14 being different from the distance "b" between the free ends of insulation displacement contacts 20 of the two rows as projected onto the end surface.

2. A multipin connector assembly for electrical conductors comprising;

a lower block 10 and an upper block 12;

means defining receiving channels 14 for the conductors in the lower block which proceed from a side surface and pass through the lower block;

means defining contact channels 18, which lead down from the top surface of the lower block disposed generally perpendicularly to said side surface, and passing into the lower block;

insulation displacement contacts 20 in the upper block of a similar array to the arrangement of contact channels 18, said displacement contacts projecting from the bottom surface of the block whereby when the upper block 12 is set down onto the lower block 10, the insulation displacement contacts 20 of the upper block pass through the contact channels 18 of the lower block and make contact with conductors 16 passing through the receiving channels 14 of the lower block;

a plurality of soldering terminals 22 projecting from the top of upper block 12 corresponding in number and arrangement to the insulation displacement contact 20;

the lengths of the insulation displacement contacts 20 being dimensioned in such a way that as the insulation displacement contacts 20 pass through the contact channels 18, they do not contact all the conductors 16 passing through the associated receiving channels 14 simultaneously;

said insulation displacement contacts 20 being divided into at least two groups, the contacts of each group being all of the same length, the insulation displacement contacts 20 of the respective groups contacting the associated conductors 16 in sequence as the contacts are pushed through the contact channels 18; and said receiving channels 14 being arranged in two rows $R_1$, $R_2$, one above the other a predetermined distance so that the receiving channels 14 of the upper row $R_1$ are offset with respect to the receiving channels 14 of the lower row $R_2$, said contact channels 18 being arranged in two rows $R_3$, $R_4$ separated from each other in the axial direction of the receiving channels 14; and the distance between the two rows of receiving channels 14 being different from the distance between the free ends of insulation displacement contacts 20 of the two rows as projected onto the end surface.

* * * * *